US011712080B2

(12) United States Patent
Roemer

(10) Patent No.: US 11,712,080 B2
(45) **Date of Patent: *Aug. 1, 2023**

(54) TURBAN

(71) Applicant: Romer Millinery, Bronx, NY (US)

(72) Inventor: Christine Cox Roemer, Bronx, NY (US)

(73) Assignee: Romer Millinery, Bronx, NY (US)

( * ) Notice: Subject to any disclaimer, the term of this patent is extended or adjusted under 35 U.S.C. 154(b) by 92 days.

This patent is subject to a terminal disclaimer.

(21) Appl. No.: 17/190,588

(22) Filed: Mar. 3, 2021

(65) Prior Publication Data

US 2021/0330015 A1 Oct. 28, 2021

Related U.S. Application Data

(63) Continuation of application No. 15/040,714, filed on Feb. 10, 2016, now Pat. No. 10,959,471.

(60) Provisional application No. 62/114,103, filed on Feb. 10, 2015.

(51) Int. Cl.
*A42B 1/041* (2021.01)

(52) U.S. Cl.
CPC ..... *A42B 1/041* (2013.01)

(58) Field of Classification Search
CPC ... A45D 8/34; A45D 8/36; A45D 8/40; A41G 5/0093; A42C 5/00; A42C 5/02
USPC ..... 132/273, 274, 275
See application file for complete search history.

(56) References Cited

U.S. PATENT DOCUMENTS

| | | | | | |
|---|---|---|---|---|---|
| 2,209,130 | A * | 7/1940 | Mueller | A47G 25/66 | 223/63 |
| 2,923,448 | A * | 2/1960 | Mueller | A47G 25/66 | 223/63 |
| 4,790,035 | A * | 12/1988 | Whyte | A41D 23/00 | 2/207 |
| 5,867,833 | A * | 2/1999 | LeDonne | A41D 23/00 | 2/DIG. 11 |
| 6,263,512 | B1 * | 7/2001 | LeDonne | A41D 23/00 | 132/273 |
| 8,782,816 | B2 * | 7/2014 | Bielobocky | A41D 23/00 | 2/207 |
| 10,959,471 | B2 * | 3/2021 | Roemer | A41D 27/06 | |
| 2005/0229943 | A1 * | 10/2005 | Parker | A45D 8/36 | 132/246 |
| 2006/0090245 | A1 * | 5/2006 | McGhee | A42B 1/248 | 2/206 |
| 2012/0210492 | A1 * | 8/2012 | Bielobocky | A41D 23/00 | 2/207 |
| 2014/0075647 | A1 * | 3/2014 | Perthou | A42B 1/02 | 2/171 |
| 2015/0007377 | A1 * | 1/2015 | Pavalon | A41D 23/00 | 2/69 |

(Continued)

*Primary Examiner* — Jocelyn Bravo
(74) *Attorney, Agent, or Firm* — Charney IP Law LLC

(57) ABSTRACT

A turban has an outer shell forming an enclosed interior space with an interior perimeter. At least one sleeve, which is open at its ends, is formed within the interior space along the interior perimeter. A malleable wire is threaded through the open ends of the at least one sleeve such that the wire extends around the interior perimeter of the outer shell, the wire having two ends bound together. The turban may be wrapped around the head of a user, for example as a fashion accessory, while being held in place by the wire.

25 Claims, 7 Drawing Sheets

(56) References Cited

U.S. PATENT DOCUMENTS

2016/0227865 A1* 8/2016 Roemer ..... A42B 1/041

* cited by examiner

TURBAN

CROSS-REFERENCE TO RELATED APPLICATIONS

The present application is a continuation application of U.S. patent application Ser. No. 15/040,714 entitled "Turban," filed Feb. 10, 2016, which claims the benefit of U.S. Provisional Application Ser. No. 62/114,103 entitled "Turban," filed Feb. 10, 2015, the disclosures of which are hereby incorporated by reference herein.

BACKGROUND OF THE INVENTION

The present invention relates to apparel, particularly fashionable turbans for women. Conventionally, such turbans are worn as wrapped headwear but it is to be understood that other arrangements, as provided herein or otherwise, may also be adopted. Such arrangements include use as a scarf.

Historically, turbans have been worn for religious purposes by men and women. Today, women have adopted the turban as a fashionable portion of their wardrobe. Yet, conventional wrapped turbans are difficult to wrap for many women and therefore use is limited to those with the skills and desire to learn the craft, or with someone available to assist them. Even then, there are limited manners in which the turban may be wrapped, thus resulting in predictable appearances.

BRIEF SUMMARY OF THE INVENTION

It would therefore be advantageous to provide wearing apparel, particularly a turban, that can be easily wrapped in an array of unique and fashionable arrangements.

In a preferred embodiment of the invention, a turban comprises an outer fabric having a centerline splitting the outer fabric into a second half and a first half. A series of sleeves are sewn around the perimeter of the second half such that a first sleeve is located adjacent the centerline and the remaining sleeves are located around the perimeter with gaps between the sleeves. Each sleeve is open at its ends such that a wire may be threaded through the sleeves and positioned along the outer limits of the second half.

The wire may include overlapping endpoints that are bound or the wire may be continuous. The wire may be bound by twisting the ends together and/or bound with adhesive tape.

To form the preferred turban, the first half is folded over the second half at the centerline whereupon the newly adjacent edges are sewn. It is also noted that in other embodiments the first half and second half may instead be comprised of two separate pieces of fabric, in which case four seams at four newly adjacent edges would need to be sewn.

In other embodiments of the turban there may be simple exterior stitching located to hold the wire in place in addition to, or in lieu of, a sleeve or sleeves.

In a further embodiment, a turban has an outer shell forming an enclosed interiors space, the outer shell having an interior perimeter with at least one sleeve formed within the interior space along the interior perimeter of the outer shell, the at least one sleeve being open at its ends; and a malleable wire threaded through the open ends of the at least one sleeve such that the wire extends around the interior perimeter of the outer shell, the wire having two ends bound together; wherein the turban may be placed upon the head of a user.

The at least one sleeve may be a series of discontinuous sleeves, where the wire extends through each of the series of discontinuous sleeves.

The outer shell may be crescent shaped.

The wire may be covered with plastic tape.

The outer shell may be formed from a single piece of fabric.

The at least one sleeve may be formed with a seam allowance along the interior perimeter of the outer shell.

The at least one sleeve may be sewn to the interior perimeter of the outer shell when a finished side of the outer shell is facing toward the interior enclosed space.

The outer shell may be formed from more than one piece of fabric.

In accordance with another embodiment of the present invention, a turban may be formed by, and not necessarily in this order, obtaining a piece of fabric having a first half and a second half; placing the first half over the second half; sewing the outside perimeter together except in an open area; sewing a series of discontinuous sleeves with open ends along portions of the perimeter of the second half; inverting the first half and second half through the open area; threading a malleable wire having two ends through the open area and the discontinuous sleeves; binding the two ends of the wire together; and sewing the open area closed.

The first half and the second half may be two halves of the same piece of fabric and the step of placing may include folding.

At least one of the first half and the second half may be formed from more than one piece of fabric.

The step of sewing the outside perimeter may be performed prior to sewing a series of discontinuous sleeves.

The series of discontinuous sleeves may include at least one sleeve on each side of the second half.

The forming may further include instructing a user to wrap the turban around the head of the user. In such case, the instructions may further include instructing the user to leave at least a portion of the turban cantilevered off the head of the user.

In a further embodiment of the invention, a turban includes an outer shell forming an enclosed interior space, the outer shell having an interior perimeter; a series of tubular sleeves sewn within the interior space along the interior perimeter of the outer shell, the series of tubular sleeves open at their respective ends; and a malleable wire threaded through the open ends of the tubular sleeves such that the wire extends around the interior perimeter of the outer shell, the wire having two ends bound together; wherein the turban may be placed upon the head of a user.

The outer shell may be formed from a single piece of fabric.

The series of tubular sleeves may be sewn to the interior perimeter of the outer shell when a finished side of the outer shell is facing toward the interior enclosed space.

The turban may be non-rectangular.

BRIEF DESCRIPTION OF THE DRAWING FIGURES

With respect to the drawings, FIG. 1 depicts an interior plan view of a conventional fashion turban;

DETAILED DESCRIPTION

Figure 1:
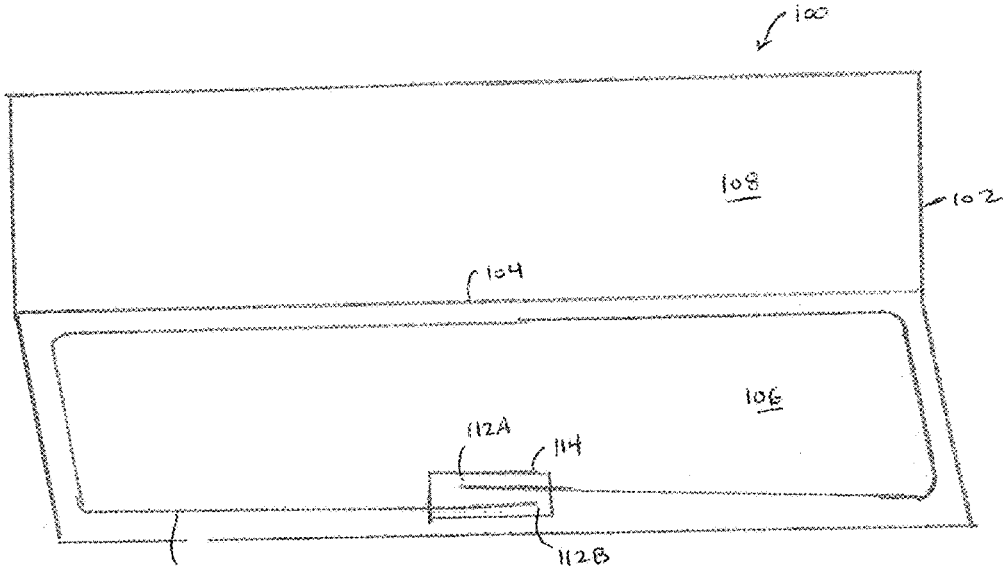
FIGURE 1 (PRIOR ART)

In the following are described the preferred embodiments of the TURBANS of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

Figure 2:
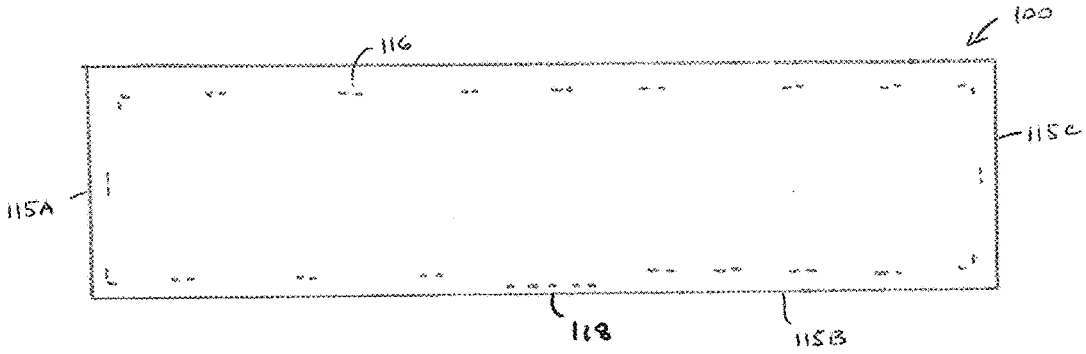
FIGURE 2 (PRIOR ART)
FIG. 2 depicts an exterior plan view of the conventional fashion turban of FIG. 1, in a finished configuration.

While details of the invention may be appreciated by considering the entirety of the submission, this detailed description begins with a discussion of one conventional fashion turban as shown in FIGS. 1 and 2. Such turbans 100, of which an interior plan view is shown in FIG. 1, comprise an outer fabric 102 having a centerline 104 splitting the outer fabric into a bottom half 106 and top half 108 (the terms bottom half and top half refer to the views shown in the various drawings and therefore should be considered interchangeable, such as a first half and a second half). A wire 110 is positioned along the outer perimeter of inside of the turban 100 as shown. The wire 110 includes endpoints 112A, 112B which overlap to form a continuous loop. The endpoints 112A, 112B are bound with a binding material 114, such as tape or wire, wrapped there around. In the finished condition, the wire 110 aids to hold the turban 100 in place on a user's head so the turban may be wrapped around the head in a fashionable manner.

To form the turban, the top half 108 is folded over the bottom half 106 at the centerline 104 with the finished side of the material toward the inside, whereupon the newly adjacent edges 115A, 115B, 115C are sewn (sewn lines not shown for clarity) in a conventional manner leaving an open area 118 of approximately 4-6" in length along one edge 115B. The entire turban 100 is then flipped "right side out" through the open area 118. The wire 110 is the positioned through the open area 118 into the interior of the turban 100 where it is secured in place by strategically located stitching 116 placed through the top half 108 and bottom half 106 as shown in FIG. 2. This stitching may be located in various locations around the exterior of the turban 100 to lock the wire 110 between the stitching 116, the newly adjacent edges 115A, 115B, 115C, and the centerline 104. The open area 118 is then stitched closed and the turban 100 is complete.

As a point of reference, the strategic locations are typically those where the stitching 116 is least likely to be seen. For example, the stitching may be placed in a location that includes a solid color where the stitching then matches the solid color. Or the stitching may be placed in a patterned area in such a way that the stitching aligns with the pattern or is otherwise blended or camouflaged therein. Ten stitched areas are shown in FIG. 2 but it will be appreciated that a greater or lesser number may be utilized.

Although this stitching can be satisfactorily hidden for certain fabrics, it has been found that other fabrics are more of a challenge. For these fabrics it would be desirable to eliminate this stitching entirely or at least in portions of the turban, or otherwise hide the stitching.

Additionally, adding the wire 110 in this manner leaves the turban 100 rather flat, whereas it would be preferred to provide a turban with a fuller more voluminous appearance.

Figure 3:
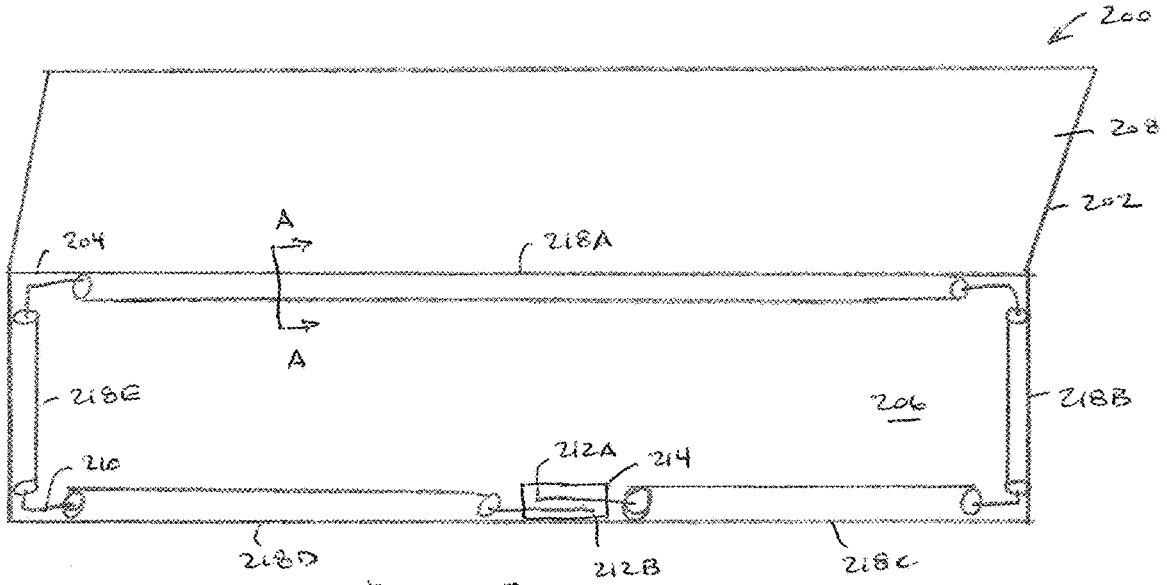
FIG. 3 depicts an interior plan view of a fashion turban in accordance with one aspect of the present invention.

FIG. 3 depicts an internal plan view of one manner of hiding the stitching and providing a more voluminous appearance, in accordance with one aspect of the present invention. In this embodiment, a turban 200 comprises an outer fabric 202 having a centerline 204 splitting the outer fabric into a bottom half 206 and top half 208 (again, the terms "top" and "bottom" refer to orientation in the drawing figure and may be used interchangeably). A series of sleeves 218 are sewn around the perimeter of the bottom half 206 such that a sleeve 218A is located adjacent the centerline 204 and the remaining sleeves 218B, 218C, 218D, 218D are located around the perimeter with gaps between the sleeves. Although the disclosure of FIG. 3 is shown with five sleeves, there may be virtually any number of sleeves and the sleeves may be of any length required. For example, there may be a series of sleeves being 1" in length, a series of sleeves being 6" in length, or a series of sleeves being of varying lengths.

Stitching for the sleeves, for example sleeve 218A, would be seen along centerline 204 but nonetheless would blend in and have the appearance of a standard edge. More details of this stitching are shown with respect to FIG. 5.

Each sleeve 218A-E, which are preferably tubular sleeves, is open at its ends. The openings are formed such that a wire 210 may be threaded through the sleeves 218A-E and positioned along the outer limits of the bottom half 206 as shown. The wire 210 includes endpoints 212A, 212B which preferably overlap. The endpoints 212A, 212B are then bound with binding material 214 such as tape or wire. In preferred embodiments, the endpoints 212A, 212B are twisted around each other along the length of the wire 210 and covered with adhesive tape.

Figure 4:
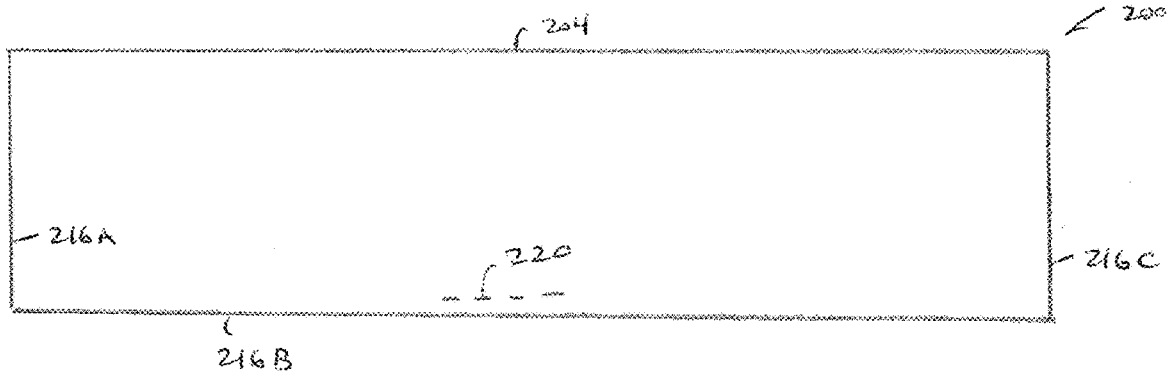
FIG. 4 depicts an exterior plan view of the fashion turban of FIG. 3, in a finished configuration.

To form the turban, the top half 208 is folded over the bottom half 206 at the centerline 204 whereupon the newly adjacent edges 216A and 216C, shown in FIG. 4, are sewn (sewn lines not shown for clarity) to begin forming an enclosed interior space with the finished sides of the fabric toward the inside of the interior space. Edge 212B is then sewn with the exception of an open area 220 of approximately 4" to 6" in length, adjacent to the wire endpoints 212A, 212B. The sleeves 218A-E are then sewn in place. The turban 200 is then inverted through the open area 220 such that it is "right side out," whereupon the wire 210 is threaded through the open area and the sleeves 218A-E. The wire 210 is then secured as discussed and the open area 220 is sewn shut, the open area representing the only visible stitching on the exterior surface of the turban 200.

It will be appreciated that the open area 220 may be positioned in a different location along the perimeter of the turban where it may be advantageous to hide the exposed stitching. Additionally, it is noted that the top half 208 and bottom half 206 may instead be comprised of two separate pieces of fabric, in which case four seams at four newly adjacent edges would need to be sewn, again forming an enclosed interior space with the finished side of the fabric toward the inside of the interior space. In other embodiments, each of the fabric halves can themselves be formed from multiple pieces of fabric stitched or otherwise fused together.

By forming a turban with sleeves as described, the wire 210 is held in place much more securely than in the prior art, which permitted the wire to deviate from a fixed position as the turban material gathered in use. Moreover, the sleeves add volume and fullness to the turban, creating a loftier appearance which many find more visually appealing than a flat turban.

Figure 5:
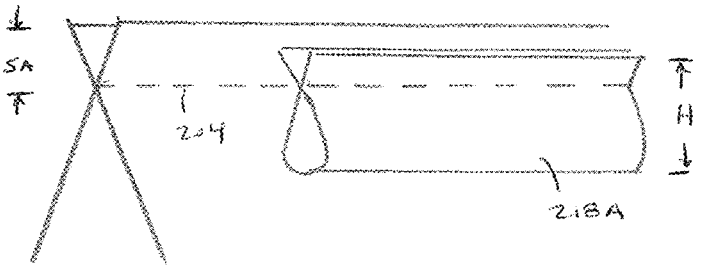
FIG. 5 depicts a side perspective view of portions of the fashion turban of type shown in FIG. 3 in accordance with one embodiment.
Figure 6:
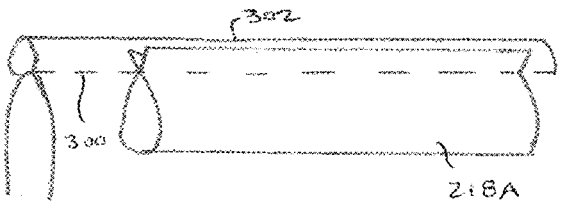
FIG. 6 depicts a side perspective view of portions of the fashion turban of the type shown in FIG. 3 in accordance with another embodiment.

FIG. 5 depicts a side perspective view of portions of the fashion turban of FIG. 3 when formed from two pieces of fabric, generally along cross section A-A. One will appreciate that centerline 204 is sewn with an approximately ½" to ¼" seam allowance SA. The sleeve 218A is formed from an approximately 4" strip of fabric and is therefore approximately 2" in height H overall once folded. It is then sewn directly over the existing centerline 204 stitching to hide the sleeve stitching. In an alternate embodiment, particularly where the type of fabric permits, the sleeve 218A can be sewn simultaneous with the centerline stitching 204. The types of fabrics that permit this procedure are those of relatively high friction, such as cotton. Silks and velvet fabrics tend not to lend themselves to this procedure unless the sleeve 218A is pinned first. Moreover, it will be appreciated that by first sewing the centerline stitching 204, and then the sleeve 218A, the bond of the centerline and the sleeve is made stronger. FIG. 6 depicts a similar view but in the case of a turban formed from a single fabric folded over. In this case there is no stitch line at the equivalent of centerline 204, so the preferred method of forming the turban is to sew in the sleeve 218A together with the making of a stitch line 300 approximately ½" to ¼" from the folded edge 302. The stitch line 300 is added to give the visual appearance of the remainder of the turban edges.

It will be appreciated that there may be a mix of sleeves, such as shown in FIGS. 3 and 4, and stitching, such as shown in FIGS. 1 and 2, used to hold the wire in place. For example, stitching may be used where it can be easily hidden with sleeves used in areas that may not be so easy. Or, one may choose to use a combination for ease of manufacture, particularly because use of sleeves is more laborious.

As an alternative to the turban 100 shown in FIG. 1, the wire 110 may be provided in one continuous loop without the need for endpoints 112A, 112B or binding material 114. Moreover, as an alternative to the turban 200 shown in FIG. 3, the wire 210 may also be provided in one continuous loop without the need for endpoints 212A, 212B or binding material 214. In this case, the wire must be placed within the turban and the sleeves sewn around the wire. This continuous wire would then be in place during the inverting step of the turban during manufacture, making that step more difficult and possibly damaging the wire.

The rectangular fashion turbans of the present invention, for example those shown in FIGS. 3 and 4, are usually finished to dimensions of approximately 45"×11" or approximately 60"×11". Of course longer, shorter, wider, or narrower, and any combination thereof, turbans may be provided. The turbans may also be other than rectangular, such as the crescent shaped turban discussed below. Other configurations include geometric and non-geometric shapes. In one embodiment, the turban may be formed from elongated material that has wavy edges.

The wire placed within the turbans is typically 2 mm aluminum wire, although other materials and sizes may be utilized. Preferable are those wires that are malleable but sufficiently stiff to hold a desired shape. Moreover the wire should be able to withstand many bending cycles. In some embodiments, the wire may be covered in tape to help resist breakage. Preferable tapes are plastic tapes in the range of ½" to ¾" in width.

The tape used to bind the wire ends can be any tape suitable for such purpose. Examples are plastic tape or aluminum tape such as the type conventionally used to join air ducts. Other aluminum tapes may be plastic covered.

Figure 7:
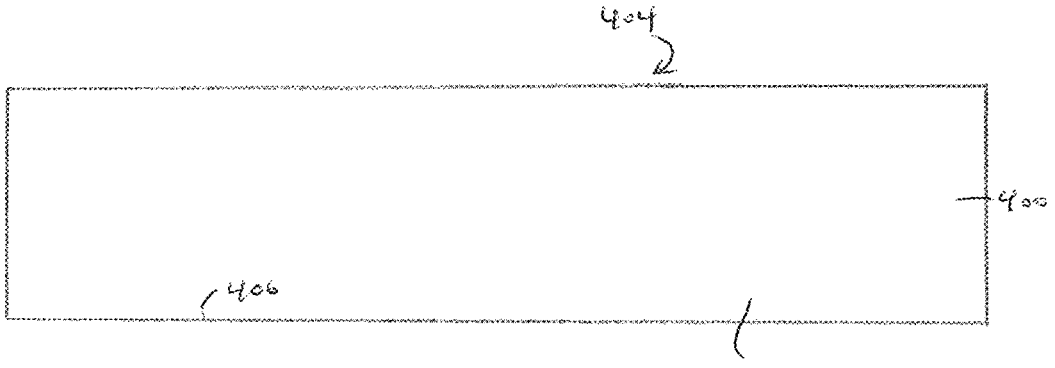
FIG. 7 depicts an exterior plan view of a fashion turban formed by two different fabrics.

FIG. 7 depicts an exterior plan view of a turban 400 formed from two fabrics, for example a cotton outer 402 over a backing of velvet 404. In this case the two fabrics are cut to generally equal sizes and sewn together in the conventional manner using stitching 406 along their edges. Although not shown, should the turban be equipped with sleeves to hold the wire, the sleeves would be sewn in following the existing stitch line between the two fabrics. Although not shown, a stitch line may also be present on the outer portion of the turban 400 where an open area was closed.

Figures 8A, 8B:
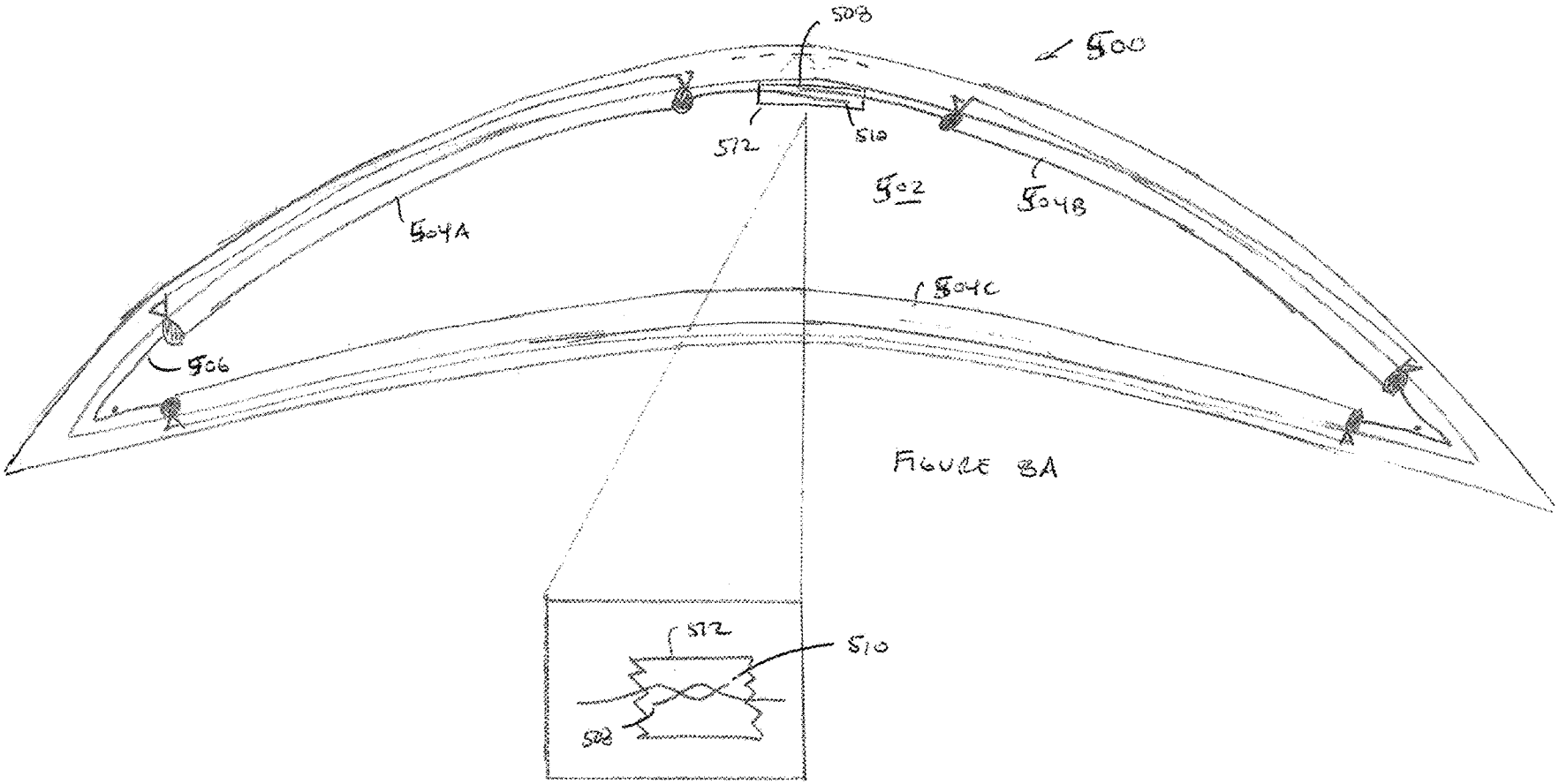
FIG. 8A depicts an interior plan view of a fashion turban in accordance with additional aspects of the present invention.
FIG. 8B depicts a blow up view of a portion of FIG. 8A with an alternate option; and, FIGS. 9-11 depict several views of turbans in use as a fashion accessory upon the head of a mannequin.

FIG. 8A depicts an internal plan view of a turban formed in accordance with other aspects of the present invention. In this embodiment, a turban 500 comprises a first outer fabric 502 and a second outer fabric (not shown). The two outer fabrics may be the same fabric or different fabrics, so long as they are the same size. In this example, the turban is a crescent shape and the fabrics are approximately 12" in overall height and 51" to 64" in overall length.

A series of sleeves 504A, 504B, 504C are sewn around the perimeter of the first outer fabric 502. As before, there are preferably gaps between the sleeves 504A, 504B, 504C.

Each sleeve 504A, 504B, 504C is open at its ends such that a wire 506 may be threaded through the sleeves and positioned along the outer limits of the first outer fabric 502 as shown. The wire 506 includes endpoints 508, 510 which preferably overlap, as shown in FIG. 8A. As shown in FIG. 8B, a blow up view of a portion of FIG. 8A showing an alternative option for the endpoints 508, 510, it is most preferred that not only do the endpoints overlap, but that they are twisted to bond the two together. Either way, the endpoints 508, 510 are then bound with binding material 512 such as tape or wire.

To form the crescent shaped turban, the first outer fabric 502 is laid flat with the finished side facing up. The finished side of the second outer fabric (not shown) is overlaid over the first outer fabric 502 such that the unfinished side is facing up. The two fabrics are then sewn together around the perimeter with a seam allowance, preferably in the range of ½" to ¾", with the exception of an open area 514, which is preferably an area approximately 4" to 6" in length along the height of the crescent's curvature. At this point the sleeves 504A, 504B, 504C are sewn in place. The first outer fabric 502 and the second outer fabric (not shown) are then inverted, or turned "right side out." The wire 506 is then threaded through each of the sleeves 504A, 504B, 504C until its two ends 508, 510 overlap in the open area 514. The two ends 508, 510 are then secured together, either by twisting followed by an adhesive tape or solely with a tape or twisting. Finally, the open area 514 is sewn closed to form an enclosed interior space and a finished turban. Alternatively, the wire 502 may be threaded through the sleeves 504A, 504B, 504C prior to the inversion step.

Figure 9:
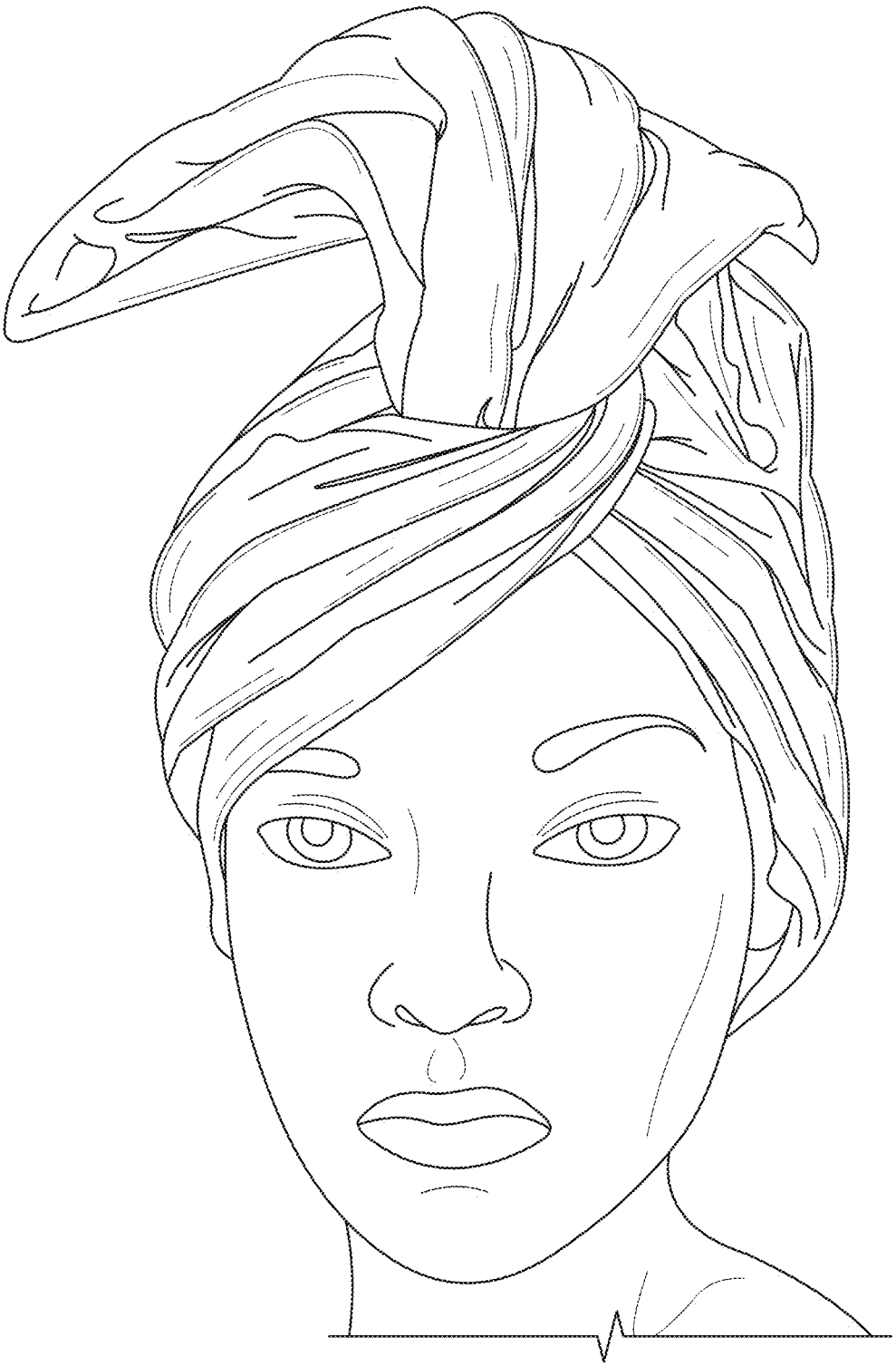
Figure 10:
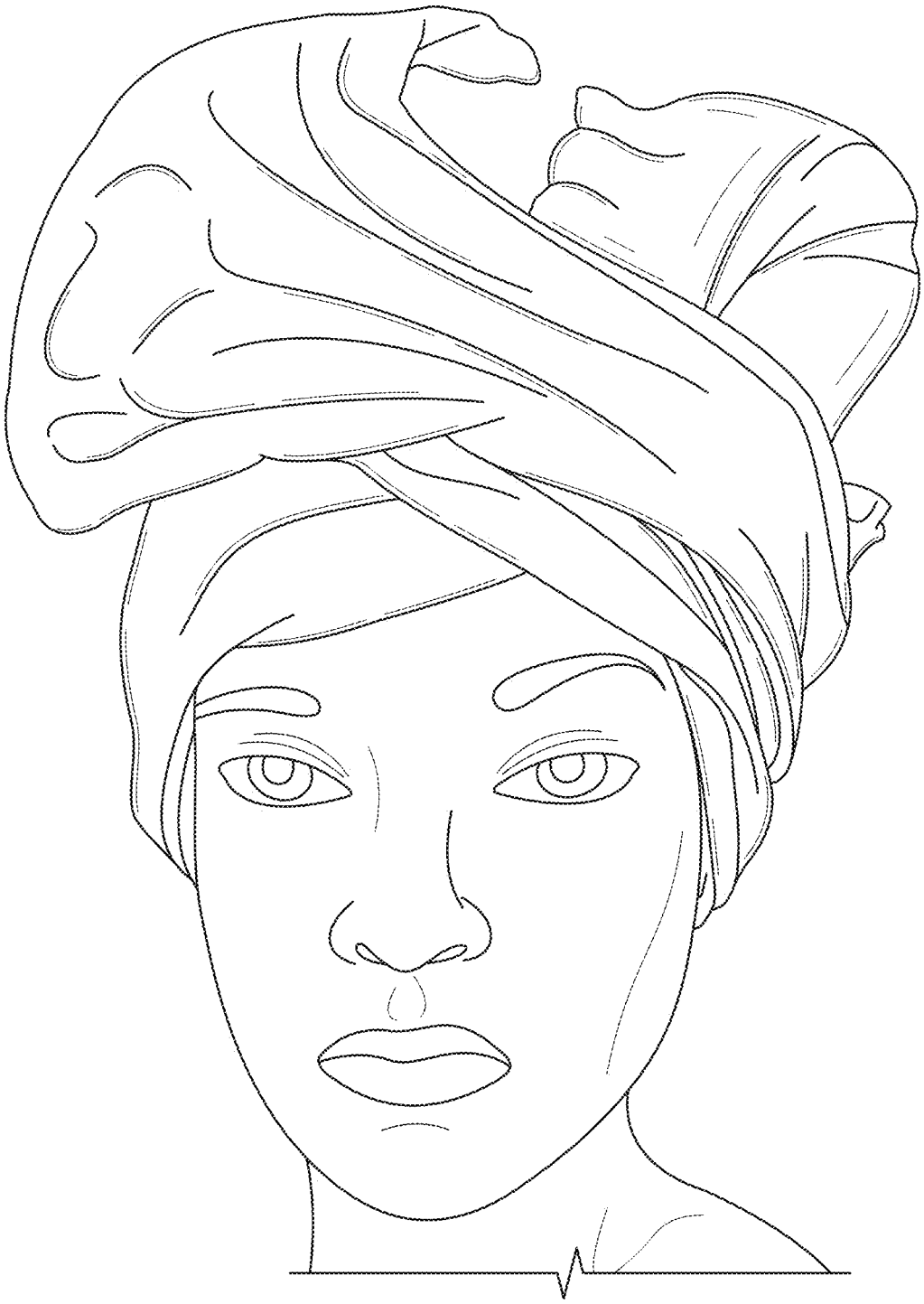
Figure 11:
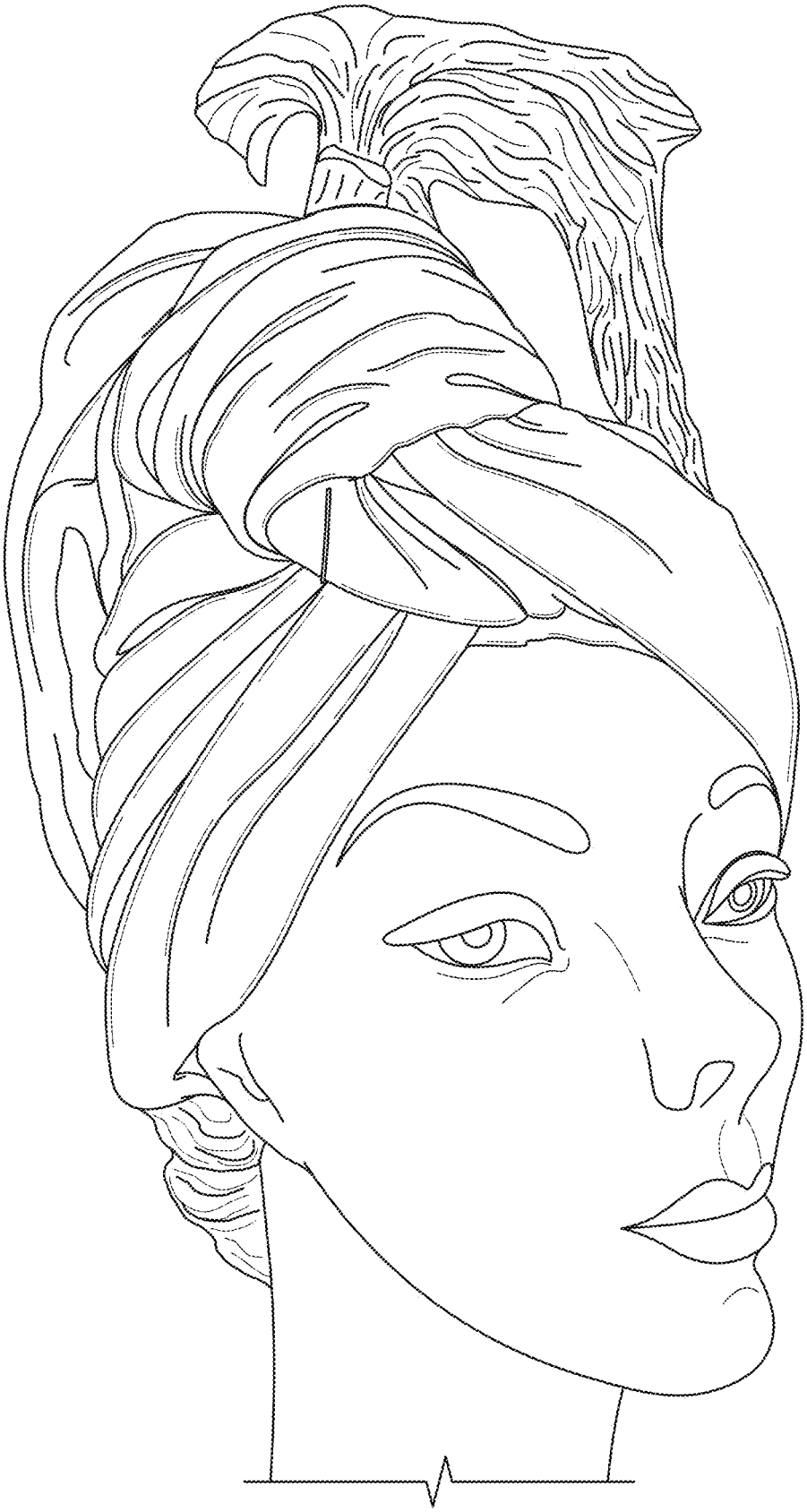

FIGS. 9-11 depict various manners in which the turbans of the present invention may be worn. Generally speaking, a user would typically begin with the turban spread out before them such as shown in FIG. 4. The user would then grasp the turban and wrap it around the user's head while twisting and tying the turban into a desired configuration. Because of the malleability and strength of the wire, the turban stays in place easily and can also be "cantilevered" off the head into various configurations, for example those shown in FIGS. 9 and 10. All of these configurations are possible without the assistance of a helper.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

I claim:

1. A turban comprising:

a first fabric having a first perimeter;

a second fabric sized and configured to overlap with said first fabric, said second fabric having a second perimeter, said first fabric and said second fabric being sewn together along said first and second perimeters to form an enclosed interior space;

at least one sleeve attached to said first fabric within said enclosed interior space, said at least one sleeve having respective opposing open ends;

a malleable wire threaded through said open ends of said at least one sleeve, said wire having two ends bound together to form a continuous loop of wire within said enclosed interior space.

2. The turban of claim 1, wherein said first fabric and said second fabric each have a height dimension and a length dimension, said length dimension being between approximately 3-6 times greater than said height dimension.

3. The turban of claim 1, wherein said at least one sleeve is a series of discontinuous sleeves, and said wire extends through each sleeve of said series of discontinuous sleeves.

4. The turban of claim 1, wherein said wire is covered.

5. The turban of claim 4, wherein said wire is plastic covered.

6. The turban of claim 1, wherein said first fabric is a different material from said second fabric.

7. The turban of claim 1, wherein said first fabric has a different pattern than said second fabric.

8. The turban of claim 1, wherein said turban includes a seam allowance related to said at least one sleeve.

9. The turban of claim 1, wherein either or both of said first fabric and said second fabric is formed from more than one piece of fabric.

10. The turban of claim 1, wherein said first fabric is crescent shaped.

11. The turban of claim 1, wherein said first fabric and said second fabric are defined from a single piece of fabric, a portion of which forms parts of said first and second perimeters prior to said first fabric and said second fabric being sewn together.

12. A turban comprising:

a first rectangular shaped fabric having a first perimeter;

a second rectangular shaped fabric sized and configured to overlap with said first rectangular shaped fabric, said second rectangular shaped fabric having a second perimeter, said first rectangular shaped fabric and said second rectangular shaped fabric being sewn together along said first and second perimeters to form an enclosed interior space;

at least one sleeve attached to said first rectangular shaped fabric within said enclosed interior space, said at least one sleeve having respective opposing open ends;

a malleable wire threaded through said open ends of said at least one sleeve, said wire having two ends bound together to form a continuous loop of wire within said enclosed interior space.

13. The turban of claim 12, wherein said first rectangular shaped fabric and said second rectangular shaped fabric each have a height dimension and a length dimension, said length dimension being between approximately 3-6 times greater than said height dimension.

14. The turban of claim 12, wherein said at least one sleeve is a series of discontinuous sleeves, and said wire extends through each of said series of discontinuous sleeves.

15. The turban of claim 12, wherein said wire is covered.

16. The turban of claim 15, wherein said wire is plastic covered.

17. The turban of claim 12, wherein said first rectangular shaped fabric is a different material from said second rectangular shaped fabric.

18. The turban of claim 12, wherein said first rectangular shaped fabric has a different pattern than said second rectangular shaped fabric.

19. The turban of claim 12, wherein said turban includes a seam allowance related to said at least one sleeve.

20. The turban of claim 12, wherein either or both of said first rectangular shaped fabric and said second rectangular shaped fabric is formed from more than one piece of fabric.

21. The turban of claim 12, wherein said first rectangular shaped fabric and said second rectangular shaped fabric are portions of a single piece of fabric, and wherein said first perimeter and said second perimeter partially overlap prior to said first rectangular shaped fabric and said second rectangular shaped fabric being sewn together.

22. A turban comprising:

a first fabric having a first perimeter;

a second fabric having a second perimeter sized to match said first perimeter, said first fabric and said second fabric being sewn together along said first and second perimeters to form an enclosed interior space;

at least one sleeve formed within said enclosed interior space, said at least one sleeve having respective opposing open ends;

a malleable wire threaded through said open ends of said at least one sleeve, said wire having two ends bound together to form a continuous loop of wire within said enclosed interior space.

23. The turban of claim 22, wherein said at least one sleeve is a series of discontinuous sleeves, and said wire extends through each sleeve of said series of discontinuous sleeves.

24. The turban of claim 22, wherein said first fabric is crescent shaped.

25. The turban of claim 22, wherein said first fabric and said second fabric are portions of a single piece of fabric, and wherein portions of said first perimeter and said second perimeter overlap prior to said first fabric and said second fabric being sewn together.

* * * * *